US005363598A

United States Patent [19]

Imai et al.

[11] Patent Number: 5,363,598

[45] Date of Patent: Nov. 15, 1994

[54] MACHINE TOOL CAPABLE OF GRINDING A WORKPIECE WITH A TRUING APPARATUS

[75] Inventors: Tomoyasu Imai, Kariya; Takani Yoshimi, Gamagori; Akihiro Matsuura, Chiryu; Toshiharu Takashima, Kariya; Toshihiro Tsutsui, Nishio; Hiroyuki Nakano, Tokai, all of Japan

[73] Assignee: Toyoda Koki Kabushiki Kaisha, Kariya, Japan

[21] Appl. No.: 17,433

[22] Filed: Feb. 12, 1993

Related U.S. Application Data

[63] Continuation of Ser. No. 757,067, Sep. 9, 1991, abandoned.

[30] Foreign Application Priority Data

Sep. 20, 1990 [JP] Japan ..... 2-248934
Sep. 20, 1990 [JP] Japan ..... 2-248935
Sep. 28, 1990 [JP] Japan ..... 2-257496

[51] Int. Cl.[5] ..... B24B 49/00

[52] U.S. Cl. ..... 51/331; 125/11.01; 451/21

[58] Field of Search ..... 51/5 D, 165.87, 165.77, 51/325; 125/2, 5, 11.01, 39

[56] References Cited

U.S. PATENT DOCUMENTS

| | | | |
|---|---|---|---|
| 2,545,676 | 3/1951 | Small | 125/39 |
| 2,776,529 | 1/1957 | Osplack | 125/5 |
| 3,605,344 | 9/1971 | Hahn et al. . | |
| 3,788,009 | 1/1974 | Williams et al. . | |
| 4,274,231 | 6/1981 | Verega | 51/5 D |
| 4,480,410 | 11/1984 | Heimer | 51/5 D |
| 4,555,873 | 12/1985 | Smith | 51/5 D |
| 4,570,387 | 2/1986 | Unno | 51/165.87 |
| 4,799,472 | 1/1989 | Tonshoff | 125/11.01 |
| 4,862,868 | 9/1989 | Dodd et al. . | |
| 4,953,522 | 9/1990 | Vetter | 125/11.01 |
| 4,984,390 | 1/1991 | Kobayashi | 51/5 D |
| 4,991,353 | 2/1991 | Wiener | 51/5 D |
| 5,042,205 | 8/1991 | Girard | 51/5 D |
| 5,044,125 | 9/1991 | Lambert | 51/5 D |
| 5,139,005 | 8/1992 | Dodd | 51/5 D |

FOREIGN PATENT DOCUMENTS

| | | |
|---|---|---|
| 63-114877 | 5/1988 | Japan . |
| 63-140362 | 9/1988 | Japan . |
| 664921 | 4/1988 | Switzerland . |

*Primary Examiner*—M. Rachuba
*Attorney, Agent, or Firm*—Oblon, Spivak, McClelland, Maier & Neustadt

[57] ABSTRACT

A machine tool having a grinding wheel for grinding a workpiece mounted on a table. The machine tool is provided with a truing apparatus for truing the grinding wheel and a measuring device for measuring the diameter of the grinding wheel after every truing operation. Both of the truing apparatus and the measuring device are mounted on a movable base. The movable base is moved between its retract position at the outside of the table and a forward position above the table. The movable base is move to the forward position to bring the truing apparatus and the touch sensor into predetermined positions for truing and measuring operations. After the truing and measuring operations, the movable base is moved away from the table and is retracted to its retract position. The truing apparatus is provided with a truer support shaft whose rotational shaft intersects with a horizontal plane with an angle of 45°, and a truer attached to the truer support shaft. The truer has a cylindrical abrasive layer formed at periphery thereof and extending along a conical plane having a top angle of 90°.

12 Claims, 10 Drawing Sheets

MACHINE TOOL CAPABLE OF GRINDING A WORKPIECE WITH A TRUING APPARATUS

This application is a continuation of application Ser. No. 07/757,067, filed on Sep. 9, 1991, now abandoned.

BACKGROUND OF THE INVENTION

1. Field of the Invention

The present invention relates to a machine tool capable of grinding a workpiece such as a machining center having a grinding capability, a grinding center and the like, and more particularly to a machine tool capable of grinding a workpiece with a truing apparatus for truing a grinding wheel of the machine tool.

2. Discussion of the Prior Art

A machine tool of the above-mentioned type is generally used for grinding a workpiece. Such machine tool is provided with a table movable in a first horizontal direction, a saddle supported by a column for movement in a second horizontal perpendicular to the first horizontal direction, and a spindle head supported by the saddle for movement in a vertical direction. A cylindrical grinding wheel having a cylindrical side surface and a bottom end surface is attached to a spindle supported by the spindle head for rotation with the spindle. The grinding wheel generally contains hard abrasive grains such as CBN (Cubic Boron Nitride) abrasive grains or diamond grains. A workpiece is mounted on the table to be ground by the grinding wheel.

In such machine tool, the cylindrical side surface and the bottom end surface of the grinding wheel are caused to contact with the workpiece to grind the workpiece. During such grinding operation, the cylindrical side surface and the bottom end surface of the grinding wheel gradually wear away and get rough. Therefore, the cylindrical side surface and bottom end surface of the grinding wheel must be trued to keep predetermined shapes.

The machine tool is therefore provided with a truing apparatus 2 on a table 1, as shown in FIGS. 1 and 2, and the grinding wheel 3 is trued with the truing apparatus 2. Namely, the base 4 of the truing apparatus 2 is mounted on the table 1, and the body 5 thereof is mounted on the base 4 and extends upwardly along an inclined direction intersecting with a horizontal plane with an angle of 45°, as shown in FIG. 2. A mounting shaft 6 is supported by the body 5 for rotation about an axis parallel to the inclined direction. A base plate *7a* of a truer 7 is detachably fixed to the upper end portion of the mounting shaft 6, which protrudes from the body 5. An abrasive layer *7b* is bonded at the periphery of the base plate *7a*, as shown in FIG. 3, and a first truing surface *7c* and a second truing surface *7d*, which perpendicularly intersect with each other, are formed at the periphery of the abrasive layer *7b*. The first truing surface *7c* becomes parallel to the horizontal plane at the truing position TP, while the second truing surface *7b* becomes parallel to a vertical plane at the truing position TP.

During a truing operation, the truer 7 is rotated by a motor through the mount shaft 6 while the grinding wheel 3 is also rotated. Under such condition, the grinding wheel 3 attached to the spindle is moved to contact with the first and second truing surfaces *7c* and *7d* of the truer 7. Namely, the bottom end surface of the grinding wheel 3 is trued using the first truing surface *7c* of the truer 7 while the cylindrical side surface of the grinding wheel 3 is trued using the second truing surface *7d*. The relative movement of the truer 7 with respect to the grinding wheel 3 is accomplished by movements of the saddle and the spindle head.

Further, the machine tool is provided on its table 1 with a touch sensor 8 for automatically measuring the diameter of the grinding wheel 3. The truing apparatus 2 and the touch sensor 8 are arranged on one end of the table 1 with a predetermined space in a direction perpendicular to the movement direction of the table 1, as shown in FIG. 1.

After truing operation, the probe *8a* of the touch sensor 8 is brought into contact with the trued side surface of the grinding wheel 3 at one side thereof and then at the other side thereof with respect to the rotational axis of the grinding wheel 3. The diameter of the grinding wheel 3 is calculated based upon two positions at which the probe *8a* comes into contact with the side surface of the grinding wheel 3. The diameter thus calculated is used for controlling the movement of the saddle in a next truing operation.

Such machine tool, however, has a problem that whole area of the upper side of the table 1 cannot be used effectively, because part of the table 1 is occupied by the truing apparatus 2 and the touch sensor 8. Namely, a space for supporting a workpiece is limited so as to prevent the workpiece and fixtures clumping the workpiece from interfering with the truing apparatus 2 and the touch sensor 8.

Also, the machine tool has a problem that the truing apparatus 2 cannot true the grinding wheel 3 accurately, because the truer 7 bends during truing operations. Namely, the abrasive layer *7b* of the truer 7 has a thin thickness in a direction parallel to its rotational axis, and the rotational axis inclines with respect to the rotational axis of the grinding wheel 3 with an angle of 45°. Therefore, the abrasive layer *7b* comes into contact with the bottom end surface of the grinding wheel 3 with an inclined posture when truing the bottom end surface, as shown in FIG. 3. As a result, the abrasive layer *7b* tends to be deformed due to a truing resistance between the abrasive layer *7b* and the grinding wheel 3, as indicated by a broken line in FIG. 3. This problem occurs in both of the truing operation for the side surface of the grinding wheel 3 and the truing operation for the bottom end surface of the grinding wheel 3. More specifically, the abrasive layer *7b* tends to bend outwardly when the truer 7 is moved in a direction in which one edge having an obtuse angle precedes, while the abrasive layer *7b* tends to bend inwardly when the truer 7 is moved in a direction in which the other edge having an acute angle precedes. Since these deformation of the abrasive layer *7b* causes vibrations or other instable conditions, it is difficult in the conventional machine tool to carry out accurate truing operations.

SUMMARY OF THE INVENTION

Therefore, a main object of the present invention is to provide a machine tool capable of grinding a workpiece with an improved truing apparatus for truing a grinding wheel of the machine tool, which can be moved away from a workpiece table of the machine tool during grinding operations, thereby ensuring the effective use of the workpiece table.

An another object of the present invention is to provide an improved truing apparatus capable of truing a grinding wheel accurately.

Briefly, a machine tool according to the present invention is provided with a grinding wheel attached to a spindle for rotation therewith, and a truing apparatus for truing the grinding wheel. The truing apparatus is mounted on a movable base, and the movable base is moved by an actuator between a first position above the surface of a workpiece table and a second position at the outside of the table. The truing apparatus is brought into a predetermined location for truing the grinding wheel when the movable base is moved to the first position. With this arrangement, the truing apparatus can be moved from the location above the table to its retract position at the outside of the table, i.e., it crosses a plane perpendicular to the table surface and coplanar with a periphery thereof, after every truing operation. Therefore, the whole are of the upper surface of the table can be used effectively for mounting a workpiece and a fixture therefor.

In the another aspect of the present invention, the truing apparatus comprises a body, a truer support shaft carried by the body for rotation about an axis intersecting with a horizontal plane with an angle of 45°, and a truer attached to the truer support shaft. The truer has a cylindrical abrasive layer formed at the periphery thereof. The abrasive layer extends outwardly along a conical plane whose center axis coincides with the axis of said truer support shaft and has a top angle of 90°, and has a truing surface perpendicular to outside and inside surfaces of the abrasive layer.

With this configuration, it is possible to prevent the truer from excessively cutting into the grinding surface of the grinding wheel even if the truer bends due to truing resistance.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiments when considered in connection with the accompanying drawings, in which.

Figure 10:
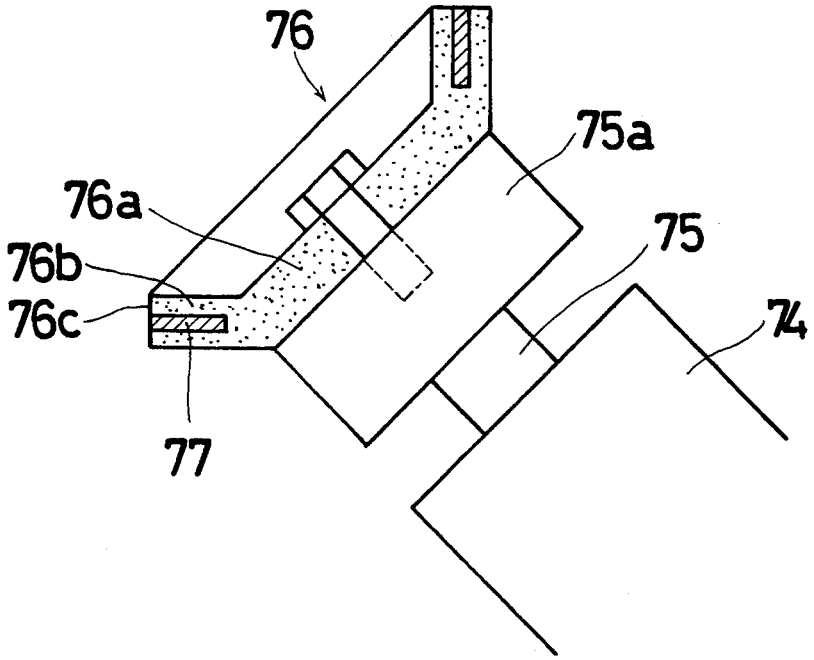
FIG. 10 is a side view of a truing apparatus according to a second embodiment of the present invention.
Figure 11A:
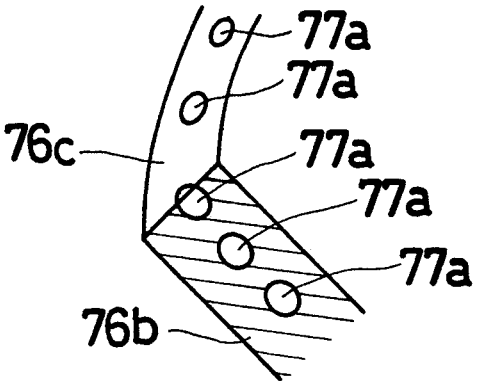
Figure 11B:
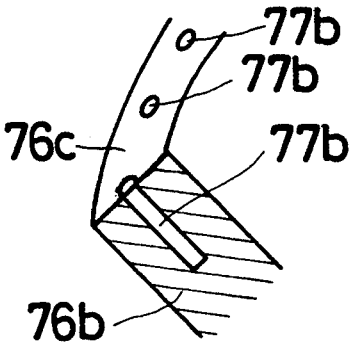
Figure 12:
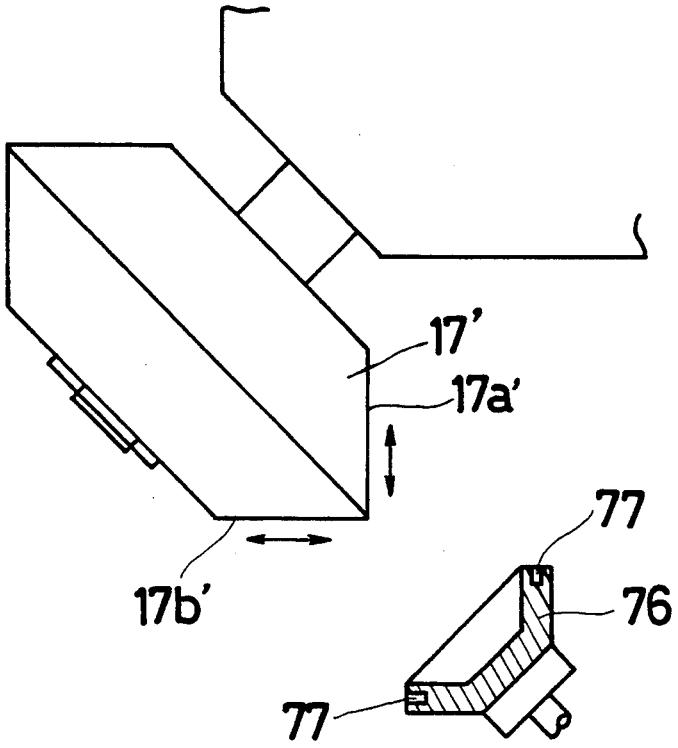

FIGS. 11 (*a*) and (*b*) are sectional views of the truer shown in FIG. 10; and FIG. 12 is a schematic view showing another type of a grinding wheel which may be trued by the truer shown in FIG. 10.

DETAILED DESCRIPTION OF THE PREFERRED EMBODIMENT

Figure 4:
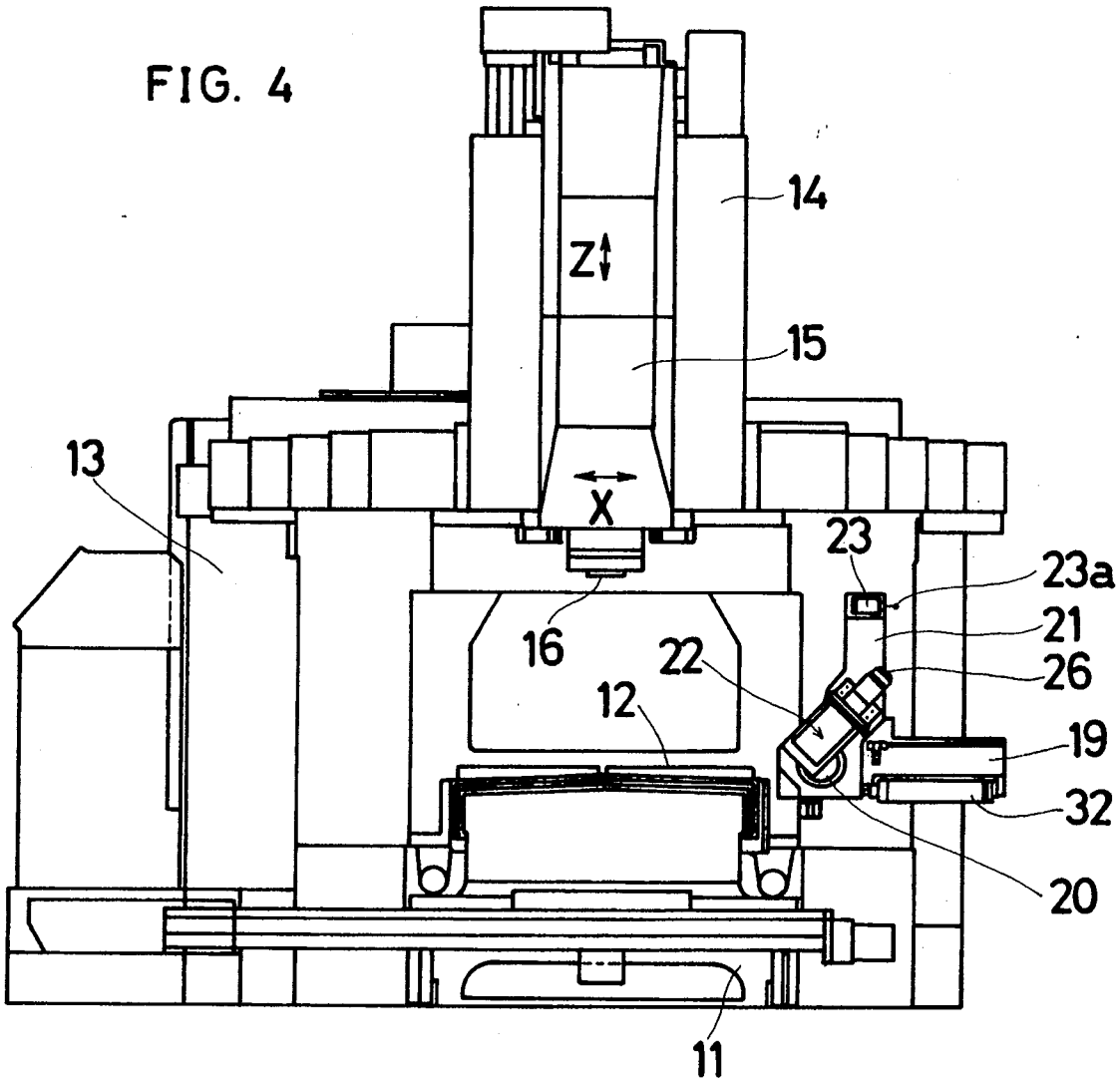
FIG. 4 is a front view of a machine tool having grinding capability according to a first embodiment of the present invention.
Figure 5:
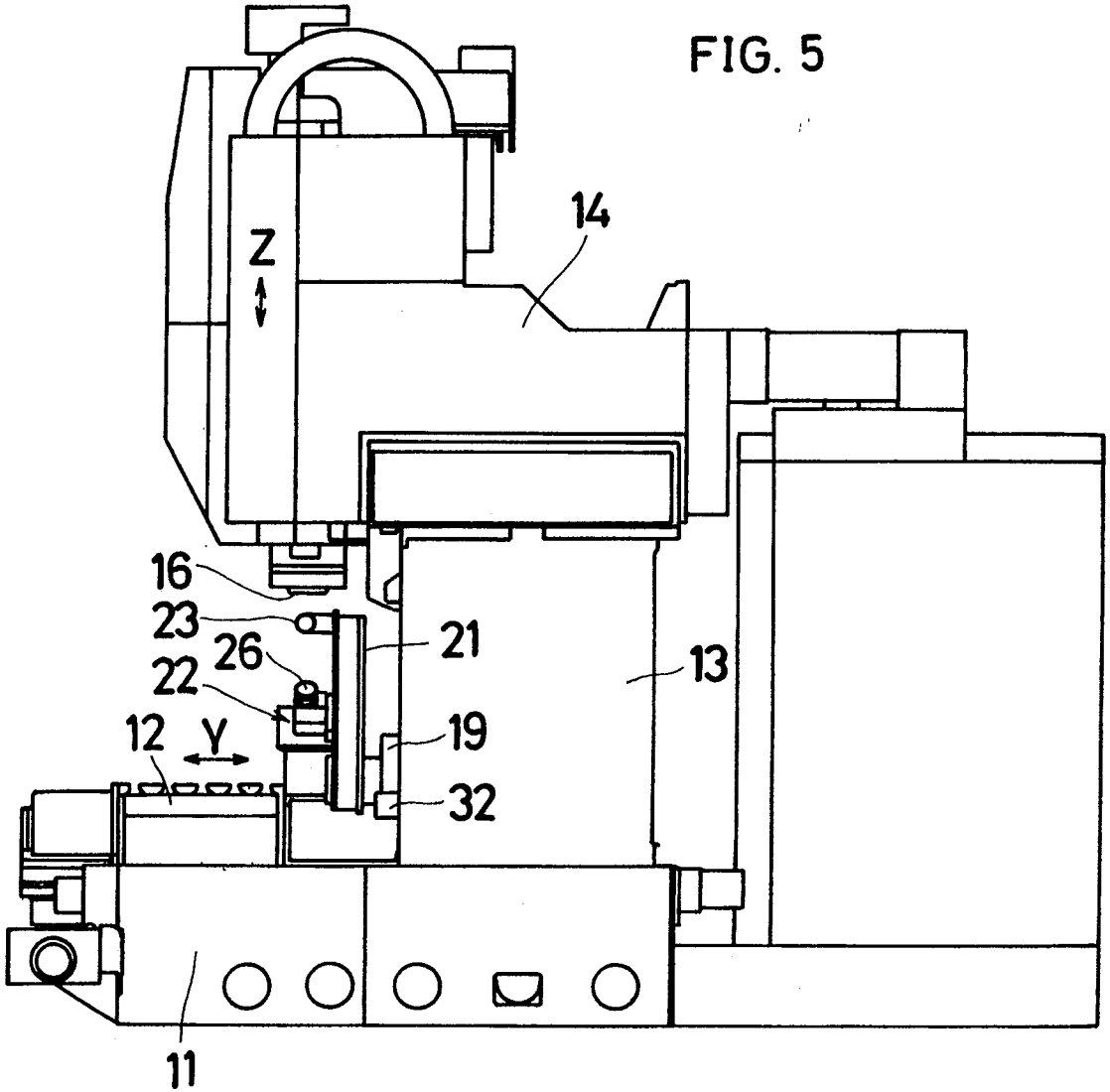
FIG. 5 is a side view of the machine tool shown in FIG. 4.
Figure 6:
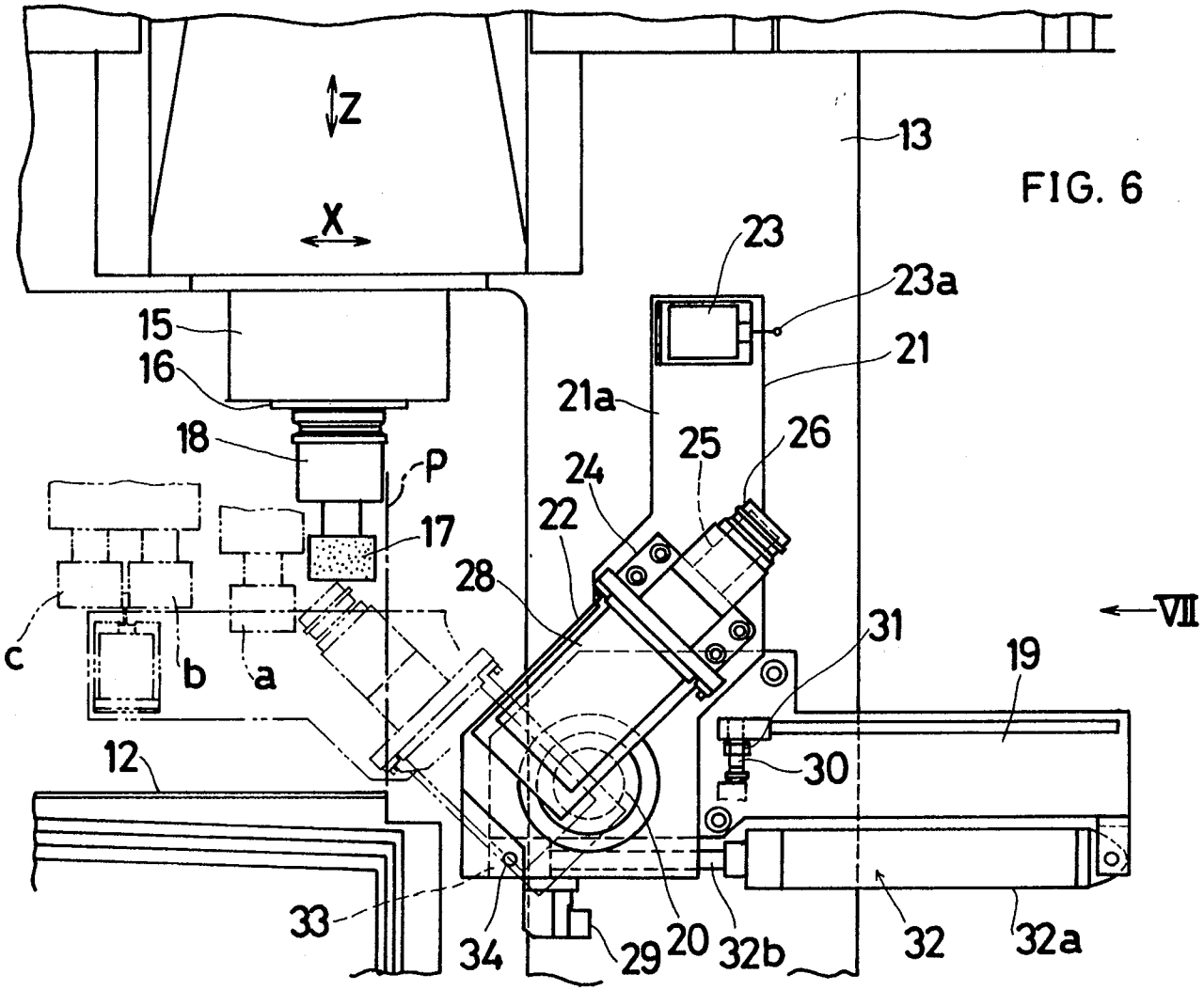
FIG. 6 is an enlarged view of the truing apparatus shown in FIG. 4.

Referring to FIGS. 4 and 5, numeral 11 is a bed of a machine tool, on which a table 12 is guided for back and forth movement along a first horizontal direction (Y-axis direction). A gantry column 13 is mounted on the bed 11 to straddle the table 12. A saddle 14 is mounted on the column 13 for lateral movement in FIG. 4 along a second horizontal direction (X-axis direction) perpendicular to the first horizontal direction. On the saddle 14, a spindle head 15 is supported for movement in a vertical direction (Z-axis direction), and a spindle 16 is carried by the spindle head 15 for rotation about a vertical axis. A cylindrical grinding wheel 17 is attached to the lower end of the spindle 16 through a tool holder 18, as shown in FIG. 6. The above-described structure is similar to that of conventional machine tools having grinding capability.

Figure 7:
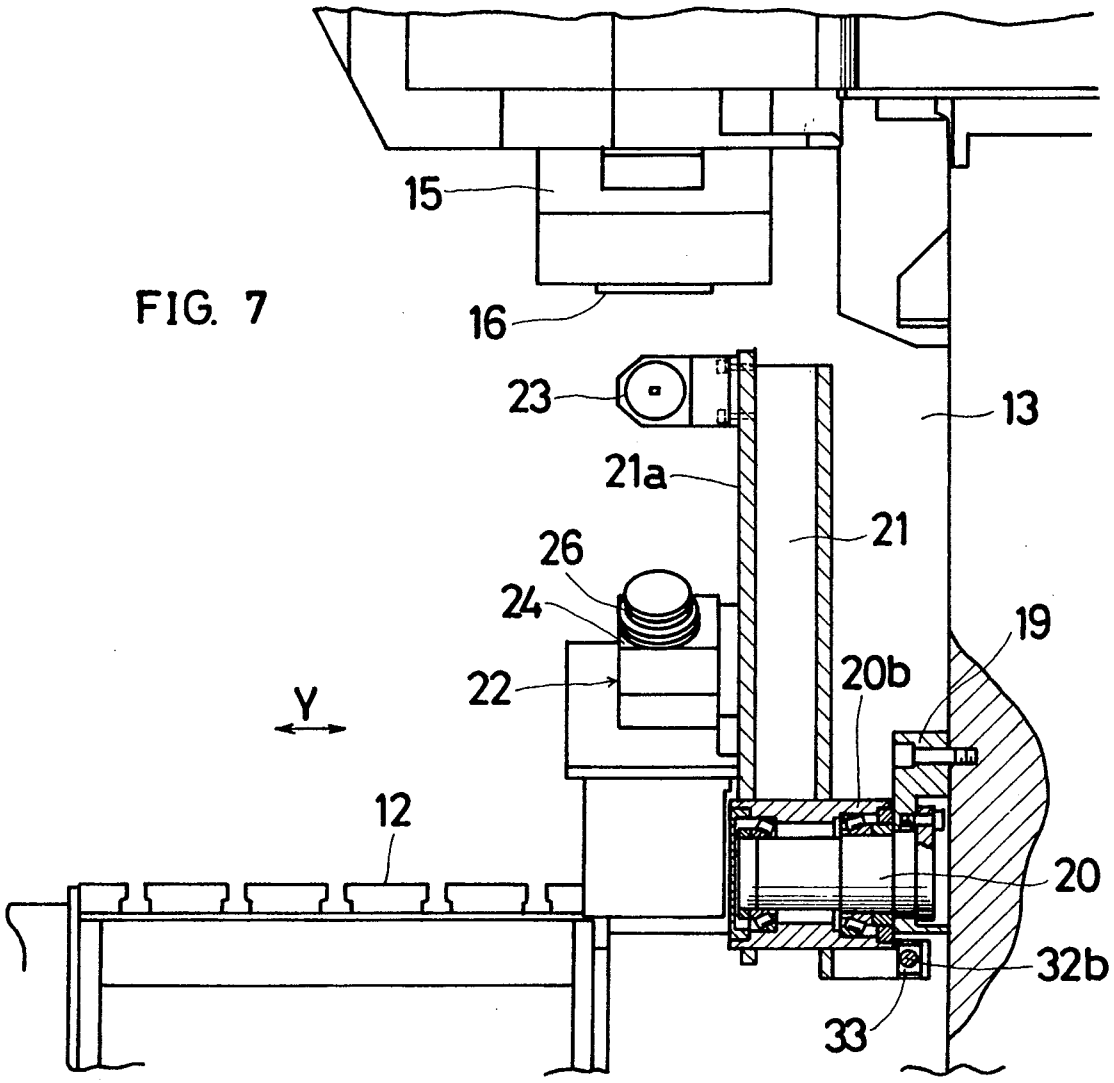
FIG. 7 is a partially sectioned side view as viewed in the direction of an arrow VII in FIG. 6.

As shown in FIGS. 6 and 7, a support base 19 is fixed to a front surface of the column 13 at a vertical location corresponding to that of the upper surface of the table 12, and the base portion of a shaft 20 is fixed to the support base 19 while the shaft 20 protrudes from the support base 19 along the Y-axis direction. A movable base 21 is supported by the shaft 20 for swing movement about the swing shaft 20 through a swing sleeve **20*b*. Further, a cylinder mechanism 32 is arranged, as an actuator, on the support base 19. Namely, the base portion of a cylinder 32*a* is pivoted on the support base 19, while the cylinder 32*a* extends along X-axis direction. The cylinder 32*a* receives a piston whose piston rod 32*b* is pivoted on the movable base 21 at its end through a block 33 and a pin 34**.

Figure 8:
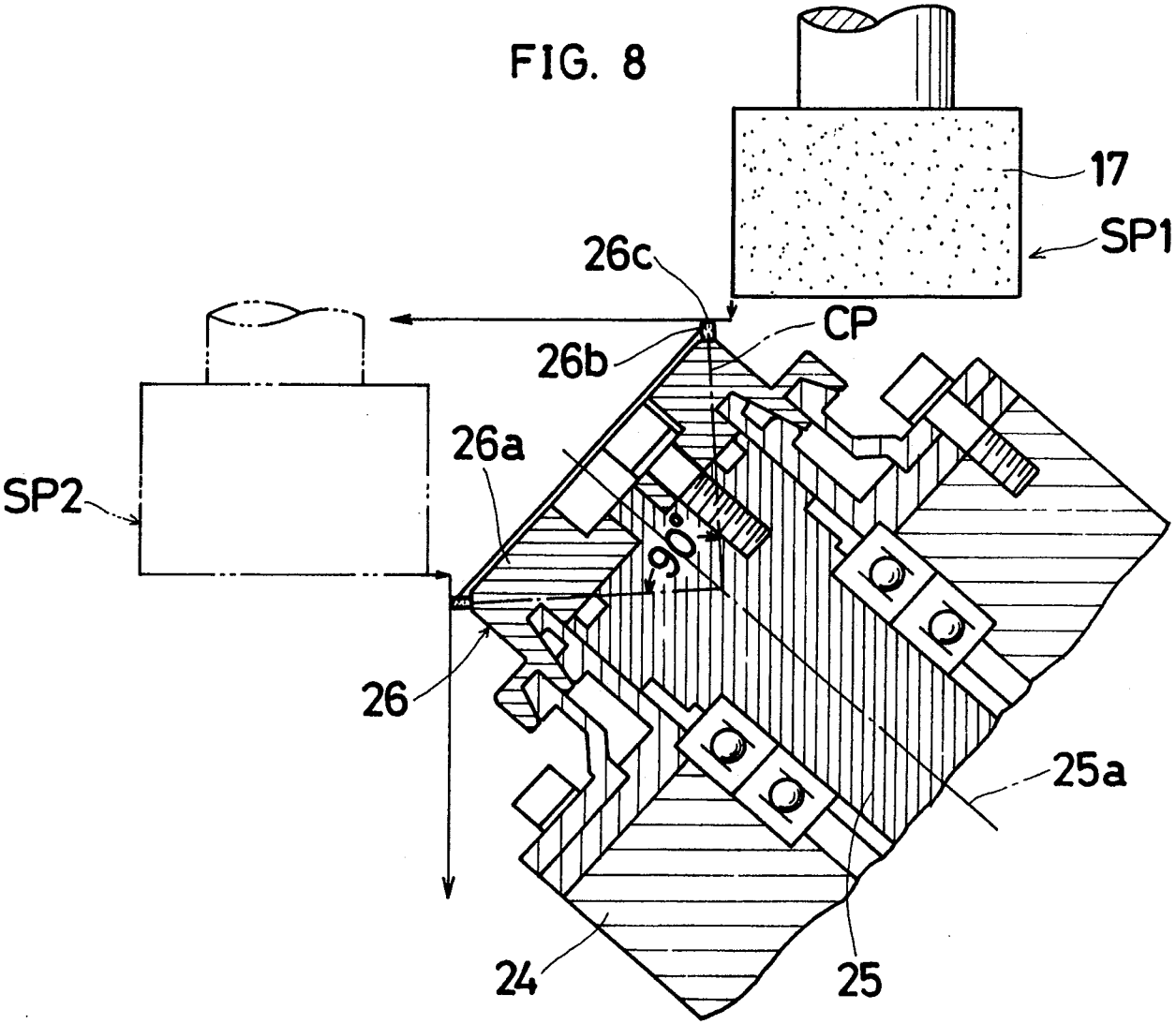
FIG. 8 is an enlarged sectional view of the truer and the supporting shaft of the truing apparatus shown in FIG. 6, the sectional view being within a plane including the rotational axis of the grinding wheel and axis of the support shaft of the truer.

Mounted on the front surface **21*a* of the movable base 21 are a truing apparatus 22 for truing and a touch sensor 23 for automatic measurement. The truing apparatus 22 and the touch sponsor sensor 23 are arranged just under the spindle 16 in Y-axis direction, as shown in FIG. 7. The body 24 of the truing apparatus 22 is mounted on the front surface 21*a* of the movable base 21 at a location near the shaft 20, and a truer support shaft 25 is rotatably carried by the body 24 through bearings, as shown in FIG. 8. The support shaft 25 is arranged to be parallel to the front surface 21*a* of the movable base 21, and its other end portion protrudes from the body 24. The circular truer base 26*a* of a truer 26 is detachably attached to the outer end portion of the support shaft 25. Further, an electric motor 28 is arranged in the body 24 to rotate the truer 26 through the support shaft 25**.

The movable base 21 is provided with a stopper block 29 while the support base 19 is provided with a stopper bolt 30 and a lock bolt 31 preventing the stopper bolt 30 form getting loose. When the movable base 21 is swung in a counterclockwise direction in FIG. 6, the stopper block 29 hits against the stopper bolt 30 at the end of the swing movement of the movable base 21, whereby the movable base 21 is positioned at a predetermined forward position.

Figure 1:
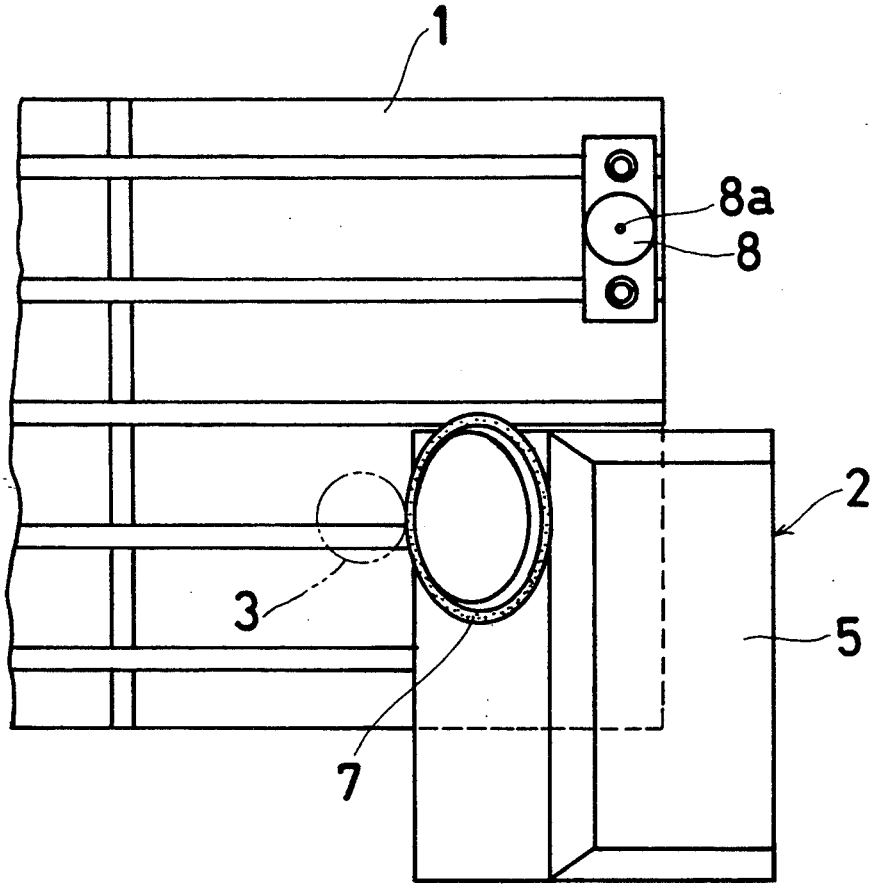
FIG. 1 (PRIOR ART)
FIG. 1 is a partial plan view of a machine tool having a conventional truing apparatus.
Figure 2:
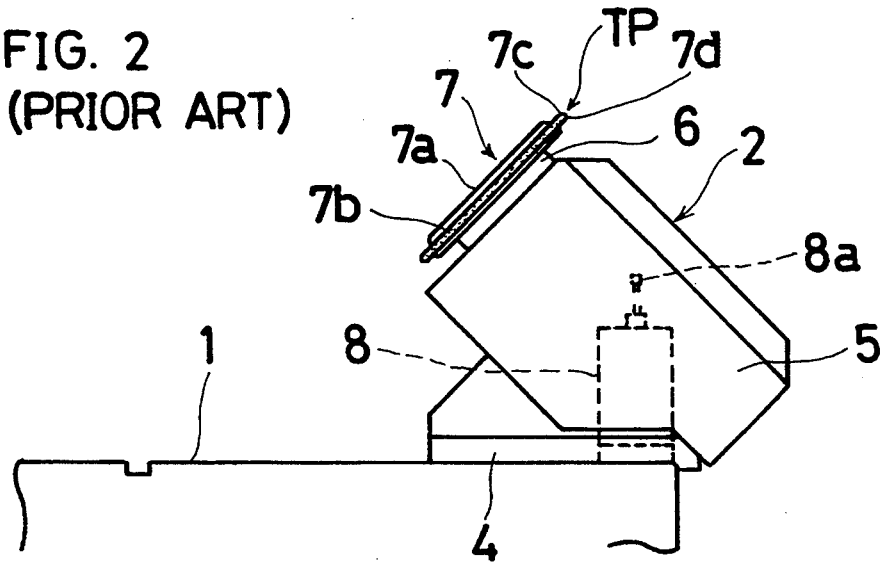
FIG. 2 (PRIOR ART)
FIG. 2 is a side view of the conventional truing apparatus.
Figure 3:
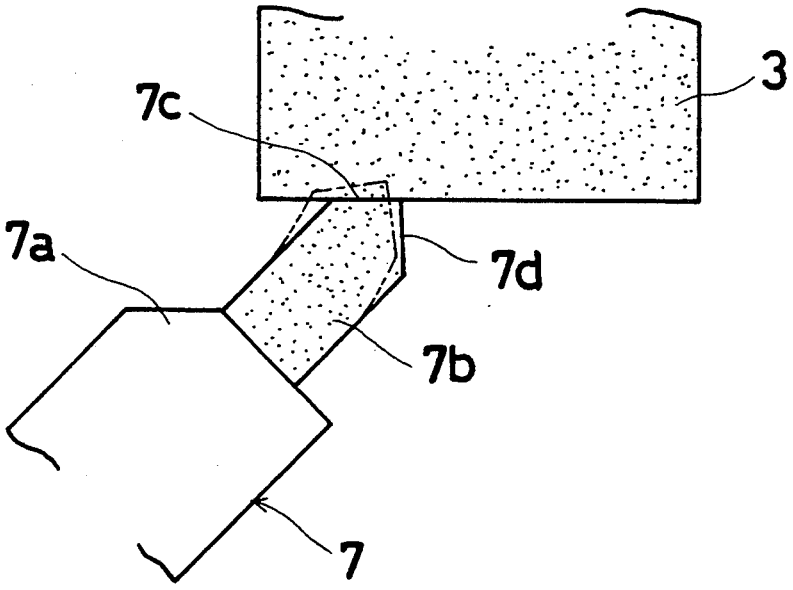
FIG. 3 (PRIOR ART)
FIG. 3 is an explanatory charts illustrating a deformation of the truer shown in FIG. 2.

The touch sensor 23 has a similar structure as that of the conventional touch sensor shown in FIGS. 1 and 2, and is provided with a probe **23*a*. The sensor 23 outputs a detection signal when the probe 23*a* comes into contact with the surface of a grinding wheel 17. The touch sensor 23 is mounted on the end portion of the front surface 21***a* of the movable base 21 to be located apart from the truing apparatus 22.

The truer 26 is provided with an abrasive layer 26*b* which is formed at the peripheral edge of the front surface of the truer base 26*a*. The abrasive layer 26*b* extends along the plane of a conical surface CP whose center axis coincides with the center axis 25*a* of the support shaft 25, and whose apex angle is 90°. The inside surface and outside surface of the abrasive layer 26*b* are parallel to each other, and a truing surface 26*c* is formed at the outer end of the abrasive layer 26*b* in such a way that the radially truing surface 26*c* perpendicularly intersects with the inner and outer surfaces of the abrasive layer 26*b*. The abrasive layer 26*b* is composed a metal bond and diamond grains embedded therein.

The operation of the truing apparatus 22 will now be described hereinafter.

During machining operations, the piston of the cylinder mechanism 32*a* is located at its retract position so that the movable base 21 is in a raised position, as indicated solid line in FIGS. 4 and 6. In this state, the truing apparatus 22 and the touch sensor 23 are located outside of the upper surface of the table 12 i.e., beyond the peripheral plane P of the top surface of the table. Put another way, the truing apparatus 22 and the touch sensor 23 are located outside of a volume defining a grinding and truing area and formed by planes (including plane P) perpendicular to the table surface and coplanar with the peripheral edge of the table surface. Therefore, a workpiece can be loaded to and unloaded from the table 12 without interference with the truing apparatus 22 and the touch sensor 23. Also, the workpiece can be ground with the grinding wheel 17 without interference with the truing apparatus 22 and the touch sensor 23.

When the grinding wheel 17 wears during the grinding operations, the truing apparatus 22 is moved onto the table 12. Namely, the piston of the cylinder 32*a* is advanced, after the workpiece is unloaded from the table 12, whereby the movable base 21 is swung in the counterclockwise direction so that the the movable base 21 is moved form its vertical position to its horizontal position while crossing the plane P. With this operation, the truing apparatus 22 and the touch sensor 23 are moved to a location above one end of the table 12. The counterclockwise movement of the movable base 21 is stopped when the stopper block 29 fixed to the movable base 21 hits against the stopper bolt 30 fixed to the support base 19. With this operation, the truing apparatus 22 is brought into a state in which the rotational axis 26*a* of the supporting shaft 25 is parallel to a line intersecting with a horizontal plane with an angle of 45°, as indicated by a broken line in FIG. 6. After that, the rotation of the truer 26 is started by activating the motor 28, and the rotation of the grinding wheel 17 is also started by rotating the spindle 16.

Figure 9:
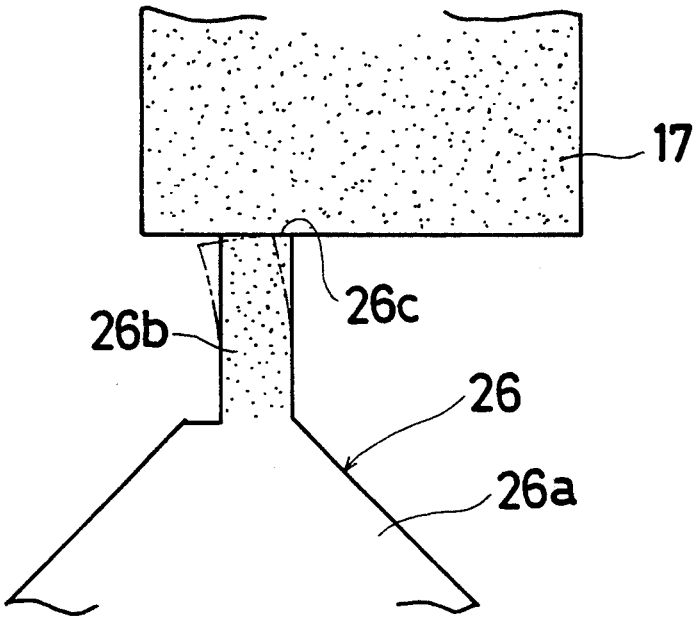
FIG. 9 is an explanatory charts illustrating a deformation of the truer shown in FIG. 8.

Under this state, the spindle head 15 is moved in the vertical direction (z-axis direction) and the saddle 14 is moved in the lateral direction (x-axis direction) so that the the grinding wheel 17 is brought to a first truing start position SP1 as indicated by a solid line in FIG. 8. The grinding wheel 17 is moved downwardly by a predetermined amount corresponding to a truing depth, and is then moved in a leftward direction. With this operation, the bottom end surface of the grinding wheel 17 is trued. During this truing operation, the abrasive layer 26*b* of the truer 26 perpendicularly contacts with the bottom end surface of the grinding wheel 17, as shown in FIG. 9. Therefore, it is possible to prevent the abrasive layer 26*b* from excessively cutting into the bottom end surface even if the abrasive layer 26*b* bends due to a truing resistance. As a result, it is possible to eliminate or reduce vibrations of the truer 26 during the truing operation. The above truing operation is repeated plural times.

Further, the grinding wheel 17 is moved to a second truing start position SP2 as indicated by a broken line in FIG. 8. The grinding wheel 17 is moved in a rightward direction by a predetermined amount corresponding to a truing depth, and is then moved downwardly. This operation repeated plural times. Since the abrasive layer 26*b* of the truer 26 perpendicularly contacts with the side surface of the grinding wheel 17 during the truing operation, the truer 26 is prevented from excessively cutting into the side surface of the grinding wheel 17. This prevents the truer 26 from vibrating during the truing operation. With this operation, the side surface of the grinding wheel 17 is trued. The side surface may be trued before truing the bottom end surface. After the truing of the bottom end surface and the side surface of the grinding wheel, the rotations of the grinding wheel 17 and the truer 26 are stopped.

After the above truing operation, the grinding wheel 17 is moved toward the probe 23*a* so that the side surface of the grinding wheel 17 comes into contact with the probe 23*a* of the touch probe 23 at its one side, as indicated by a broken line b in FIG. 6. The position in X-axis direction of the grinding wheel 17 is detected as a first position when the grinding wheel 17 comes into contact with the probe 23*a*. The grinding wheel 17 is further moved to the opposite side with respect to the probe 23*a*, and is approached to the probe 23*a* until the grinding wheel 17 comes into contact with the probe 23*a*. The position in X-axis direction of the grinding wheel 17 is detected as a second position when the grinding wheel 17 comes into contact with the probe 23*a*, as indicated by a broken line c in FIG. 6. The diameter of the grinding wheel 17 is then calculated based upon the detected first and second positions. The calculated diameter is memorized in a memory of a numerical controller (not shown), and is used for compensating the truing start positions SP1 and SP2 in a next truing operation.

After the measurement of the diameter of the grinding wheel 17, the piston of the cylinder 32*a* is retracted whereby the movable base 21 is swung in a clockwise direction about the shaft 20. With this operation, the movable base 21 is swung up to its vertical position, so that the truing apparatus 22 and the touch sponsor 23 are withdrawn from the positions above the table 12, and are moved to their retract positions. Although no workpiece is mounted on the table 12 in the above embodiment, the above truing operation can be carried out even if a workpiece is mounted on the table 12 using a fixture. In such case, the table 12 is moved to a forward end in the Y-axis direction before truing operation and measuring operations. With this preparation, it is possible to prevent interferences between the workpiece on the table 12, and the truing apparatus 22 or the touch sensor 23.

In the above embodiment, the truing apparatus 22 and the touch sensor 23 are moved between their forward positions above the table 12 and the retract positions at the outside of the table 12 by swing movement of the movable base 21 pivoted on the column 13. However, the movable base 21 may be mounted on a bracket attached to a side surface of the table 12 for swing movement. Also, truing apparatus 22 and the touch sensor 23 may be moved between the forward positions and the retract positions by linear movement of the movable base 21. In this case, the movable base 21 is guided on the column 13 for linear movement and is moved by an actuator such as a cylinder.

As described above, the truing apparatus 22 and the touch sensor 23 can be withdrawn from the positions above the table 12 after every truing operation. Therefore, a workpiece and a fixture therefor can be mounted on the table 12 without interfering with the truing apparatus 22 and the touch sponsor 23. This realizes effective use of the upper surface of the table 12.

FIG. 10 shows a second embodiment of the present invention. In this embodiment, a tool mounting head 75*a* is attached to the outer end of a support shaft 75 which is carried by the body 74. A truer 76 having a cup-like shape is fixed to the mounting head 75*a*. The truer 76 is composed of a metal bond layer 76*b* and a diamond layer 77*b* embedded in the peripheral wall portion of the truer 76. The wall portion extend outwardly along a conical plane. The diamond layer 77*b* is composed of many diamond grains 77*a*, as shown in FIG. 11 (a), and the diamond grains are embedded in the wall at a constant interval in a direction parallel to the mother line of the conical plane, and at another constant interval in the circumferential direction. The wall portion of the truer 76 has such a thickness that only one diamond exists in the direction of thickness of the wall portion.

FIG. 11 (*b*) shows another example of the truer 76, in which many diamond chips 77*b* are embedded in the metal bond layer 76*b*. Each diamond chip 77*b* having a sticklike shape is a single crystal, and is embedded at a predetermined interval in a circumferential direction in such a way that the longitudinal direction of each diamond chip 72 becomes parallel to the wall portion. The wall portion of the truer 76 has such thickness that only one diamond tip 77*b* exists in the direction of thickness of the wall portion.

Further, the truing apparatus according to the present invention may be used for truing an angular grinding wheel, as shown in FIG. 12. In this case, the grinding wheel 17' is attached to the spindle head through an attachment for rotation about an inclined axis. And a pair of grinding surface 17*a'* and 17*b'* are trued using a truer 76.

Obviously, numerous modifications and variations of the present invention are possible in light of the above teachings. It is therefore to be understood that within the scope of the appended claims, the present invention may be practiced otherwise than as specifically described herein.

What is claimed is:

1. A machine tool having a table including a surface on which a workpiece is to be mounted, said table surface having peripheral edges whereby planes perpendicular to the table surface and coplanar with the peripheral edge form a volume defining a grinding and truing area, a spindle head, a spindle carried by said spindle head, a grinding wheel attached to said spindle for rotation therewith, a moving mechanism for moving said spindle head in three dimensional directions with respect to said table for grinding said workpiece so that said grinding wheel is movable within said grinding and truing area, and a truing apparatus having a truer for truing said grinding wheel, wherein said machine tool further comprises:

a movable base on which said truing apparatus is mounted; and an actuator for moving said movable base between a first position at which said truing apparatus is in a predetermined location for truing said grinding wheel within said grinding and truing area, and a second position located such that when moving from said first position to said second position, the truer crosses a plane perpendicular to said table surface and coplanar with the peripheral edge of the table surface and is withdrawn from said grinding and truing area.

2. A machine tool according to claim 1, wherein said machine tool is further provided with a bed and a column fixed to said bed, and a saddle supported by said column for movement in a horizontal direction, said spindle head being supported by said saddle for vertical movement, and wherein said movable base and said actuator are mounted on said column.

3. A machine tool according to claim 2, wherein said truing apparatus comprises:

a body mounted on said movable base;

a truer support shaft carried by said body for rotation about an axis intersecting with the plane of said table surface at an angle of about 45° when said movable base is in the first position; and a truer attached to said truer support shaft, said truer having a circular abrasive layer extending along a conical surface, a center axis of the conical surface coinciding with the axis of said truer support shaft, the conical surface having an apex angle of about 90°, and the truer having a truing surface perpendicular to radially outside and insides surfaces of the abrasive layer.

4. A machine tool according to claim 3, wherein the abrasive layer of said truer contains plural diamond grains which are embedded therein.

5. A machine tool according to claim 4, wherein said plural diamond grains are embedded in the abrasive layer with a uniform interval in a circumferential direction of the abrasive layer and a uniform interval in a direction along the plane of the conical surface, and the abrasive layer has a predetermined thickness corresponding to the diameters of said diamond grains.

6. A machine tool according to claim 3, wherein the abrasive layer of said truer contains plural elongated diamond chips of single crystal having a sticklike shape, which extend along the plane of the conical surface and are embedded in the abrasive layer with a uniform interval in a circumferential direction of the truing layer, and has a predetermined thickness corresponding to the size of cross section of said diamond chips.

7. A machine tool according to claim 1, wherein said machine tool is further provided with a touch probe mounted on said movable base for measurement of the diameter of said grinding wheel.

8. An apparatus for truing a grinding wheel according to claim 1 wherein said movable base is pivotally mounted for movement between said first and second positions, including a touch sensor mounted to said movable base for movement therewith such that said touch sensor, when at said first position, is engageable with said grinding wheel within said grinding and truing area for detecting the dimensions of said grinding wheel and when at said second position, is remote from said grinding and truing area.

9. A machine tool having a table including a horizontal surface on which a workpiece is to be mounted, said table surface having a peripheral edge, a spindle head, a spindle carried by said spindle head for rotation about a vertical axis, a cylindrical grinding wheel attached to said spindle for rotation therewith and having a vertical peripheral surface and a horizontal bottom end surface and a moving mechanism for moving said spindle head at least in a horizontal direction and a vertical direction with respect to said table for grinding said workpiece, said machine tool further comprising:

a movable base for supporting a truing apparatus, said movable base being pivotally mounted for movement in a vertical plane perpendicular to the table surface and crossing the peripheral edge of the table surface;

a body of said truing apparatus mounted on said movable base;

an actuator for moving said movable base between a first position in which said body is in a predetermined location for truing said grinding wheel, and a second position located such that when moving between said first and second positions said body crosses a plane perpendicular to said table surface and coplanar with the peripheral edges of the table surface;

a truer support shaft carried by said body for rotation about an axis intersecting with the plane of said table surface at an angle of about 45° when said movable base is in the first position; and a truer attached to said truer support shaft, said truer having a circular abrasive layer extending along a conical surface, a center axis of the conical surface coinciding with the axis of said truer support shaft, the conical surface having an apex angle of about 90°, and the truer having a truing surface perpendicular to radially outside and inside surfaces of the abrasive layer.

10. A machine tool according to claim 9, wherein the abrasive layer of said truer contains plural diamond grains which are embedded therein.

11. A machine tool according to claim 10, wherein said plural diamond grains are embedded in the abrasive layer with a uniform interval in a circumferential direction of the abrasive layer and a uniform interval in a direction along the plane of the conical surface, and the abrasive layer has a predetermined thickness corresponding to the diameters of said diamond grains.

12. A machine tool according to claim 9, wherein the abrasive layer of said truer contains plural elongated diamond chips of single crystal having a sticklike shape, which extend along the plane of the conical surface and are embedded in the abrasive layer with a uniform interval in a circumferential direction of the truing layer, and has a predetermined thickness corresponding to the size of cross section of said diamond chips.

* * * * *